US006152796A

United States Patent [19]

Nakata

[11] Patent Number: 6,152,796

[45] Date of Patent: Nov. 28, 2000

[54] METHOD FOR MANUFACTURING AN IMAGE FORMING APPARATUS

[75] Inventor: Kohei Nakata, Machida, Japan

[73] Assignee: Canon Kabushiki Kaisha, Tokyo, Japan

[21] Appl. No.: 09/300,520

[22] Filed: Apr. 28, 1999

[30] Foreign Application Priority Data

Apr. 30, 1998 [JP] Japan ..... 10-121387

[51] Int. Cl.[7] ..... H01J 9/26

[52] U.S. Cl. ..... 445/24; 313/496

[58] Field of Search ..... 445/24, 25; 313/495, 313/496, 497

[56] References Cited

U.S. PATENT DOCUMENTS

| | | | |
|---|---|---|---|
| 5,205,770 | 4/1993 | Lowrey et al. | 445/24 |
| 5,385,499 | 1/1995 | Ogawa et al. | 445/25 |
| 5,795,206 | 8/1998 | Cathey et al. | 445/24 |

FOREIGN PATENT DOCUMENTS

| | | |
|---|---|---|
| 54-83939 | 7/1979 | Japan . |
| 62-99904 | 5/1987 | Japan . |
| 1-302642 | 12/1989 | Japan . |
| 6-310054 | 11/1994 | Japan . |
| 7-5821 | 1/1995 | Japan . |
| 9-92155 | 4/1997 | Japan . |

*Primary Examiner*—Kenneth J. Ramsey
*Attorney, Agent, or Firm*—Fitzpatrick, Cella, Harper & Scinto

[57] ABSTRACT

A method for manufacturing an image forming apparatus, which is provided with a container structured by a member including a pair of substrates with a gap between each other, an image forming member arranged in the interior of the container, and the spacers to hold the gap therebetween. The method includes the steps of pressing the spacers to the first substrate through a bonding agent, and bonding the first substrate to the second substrate through an outer frame member.

2 Claims, 10 Drawing Sheets

METHOD FOR MANUFACTURING AN IMAGE FORMING APPARATUS

BACKGROUND OF THE INVENTION

1. Field of the Invention

The present invention relates to a method for manufacturing an image forming apparatus having a spacer arranged in a container to keep a gap between image forming means and the interior of the container.

2. Related Background Art

Conventionally, as an image forming apparatus using a cold cathode electron source, there has been known an apparatus the section of which is shown in FIGS. 2A to 2C, (such as disclosed in the specification of Japanese Patent Laid-Open Application No. 02-299136).

This image forming apparatus uses the cold cathode electron source which is called the surface conductive type electron discharging device. Each of the electron discharging devices 205 is produced with the electrodes 202 and 203, and electron discharging unit 204 formed across the electrodes 202 and 203, which are arranged on a substrate 201. Also, for the face plate 206 which is arranged to face the substrate 201, the fluorescent surface 208 and metal back 211 are formed on the inner face of the glass plate 207. For the color image forming apparatus, the fluorescent surface 208 usually comprises the black conductive material 209 which is called black stripes as shown in FIG. 3, and the metal back 211 which covers both the black stripes 209 and the fluorescent device 210 after patterning the fluorescent device 210 on the glass plate 207. The provision of the black stripes 209 is aimed at making the mixture of colors or the like less conspicuous by arranging the separating part between each of the coatings of fluorescent devices 210, which are in three primary colors needed for the color fluorescent surface, and at the same time, it is aimed at preventing the contrast from being lowered due to the reflection of external light on the fluorescent surface 208.

The purpose of the provision of the metal back 211 is to prevent the potential from being lowered due to the accumulation of charges (electron) on the fluorescent device 210 having the resistance ratio of as high as $10^{10}$ to $10^{12}$ Ω·cm in general, and to enable it to function as electrodes to apply voltage for use of the electron beam acceleration, and also, to enhance the luminance by the mirror surface reflection of the light of those emitted from the fluorescent device 208 to the inner surface side of the apparatus. The purpose of the provision of the metal back is also to protect the fluorescent device 210 from negative ionic collision, among some others. As the material which is suitable for the purposes described above, Al is usually used. The metal back 211 is formed by the Al vacuum apparatus after the formation of the back stripes 209 and the fluorescent device 210 by means of patterning subsequent to the process called filming (that is, to coat an organic film on the black stripes 209 and the fluorescent device 210). After that, the organic film is removed by burning to complete the metal back. However, the strength of the metal back 211 of the fluorescent surface 208 is weak to the extent that it is peeled off when rubbed by a finger particularly after the metal back process is performed.

Also, a plurality of spacers 212 are arranged as the supporting members to resist the atmospheric pressure in order to keep the substrate 201, on which the electron discharging devices 205 are formed, and the face plate 206 substantially in a constant gap.

Among the image forming apparatuses having the aforesaid spacers in the interior of the container thereof, there are some in which many numbers of spacers are used to resist the atmospheric pressure between the face plate and the rear plate by use of the bonding material such as frit glass. In this case, it is often practiced that the face plate is arranged on the rear plate wiring in high precision, and then, it is bonded with the face plate for arrangement. Here, the bonding material made by frit glass is coated on the rear plate wiring, and the spacers to resist the atmospheric pressure are installed in high precision. Then, the process should go through the positioning to be effectuated, while the substrate is being heated uniformly as a whole. However, there a problem is encountered that this process is complicated or it may take a long time to complete it.

SUMMARY OF THE INVENTION

The present invention is designed with a view to solving the problems discussed above. It is an object of the invention to reduce the heating step in the manufacturing process of an image forming apparatus.

It is another object of the invention to reduce the heating step at high temperatures in the manufacturing process of an image forming apparatus.

It is still another object of the invention to reduce the damages that may be caused on image forming means in the heating step in the manufacturing process of an image forming apparatus.

It is a further object of the invention to provide a simple method for manufacturing an image forming apparatus.

It is still a further object of the invention to provide a method for manufacturing an image forming apparatus capable of forming images in high quality.

In order to achieve the objects described above, a method of the invention for manufacturing the image forming apparatus, which is provided with a container structured by a member including a pair of substrates with a gap to each other, and image forming means arranged in the interior of the container, and the spacers to hold the gap therein, comprises the steps of pressing spacers to the first substrate through a bonding agent; and bonding the first substrate to the second substrate through an outer frame member.

Also, the bonding agent used for this method is an inorganic bonding agent.

Also, the image forming means thus arranged for this method comprises electron discharging devices, and an image forming member to form images by irradiation of electrons from the electron discharging devices.

Also, the electron discharging devices referred to in the preceding paragraph are arranged on the first substrate, at the same time, the image forming means being arranged on the second substrate, and vice versa.

Further, in order to achieve the objectives of the present invention, the method for manufacturing the image forming apparatus, which is provided with a container structured by a member including a pair of substrates with a gap to each other, and image forming means arranged in the interior of the container, and the spacers to hold the gap therein, comprises the steps of bonding the spacers to the first substrate by use of a chemically reactive type bonding agent; and bonding the first substrate to the second substrate through an outer frame member.

Also, for this method, the image forming means comprises electron discharging devices, and an image forming member to form images by irradiation of electron from the electron discharging devices.

In this respect, it is made possible to arrange the electron discharging devices on the first substrate, and the image forming means on the second substrate, and vice versa.

Other objectives and advantages beside those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Figure 1:
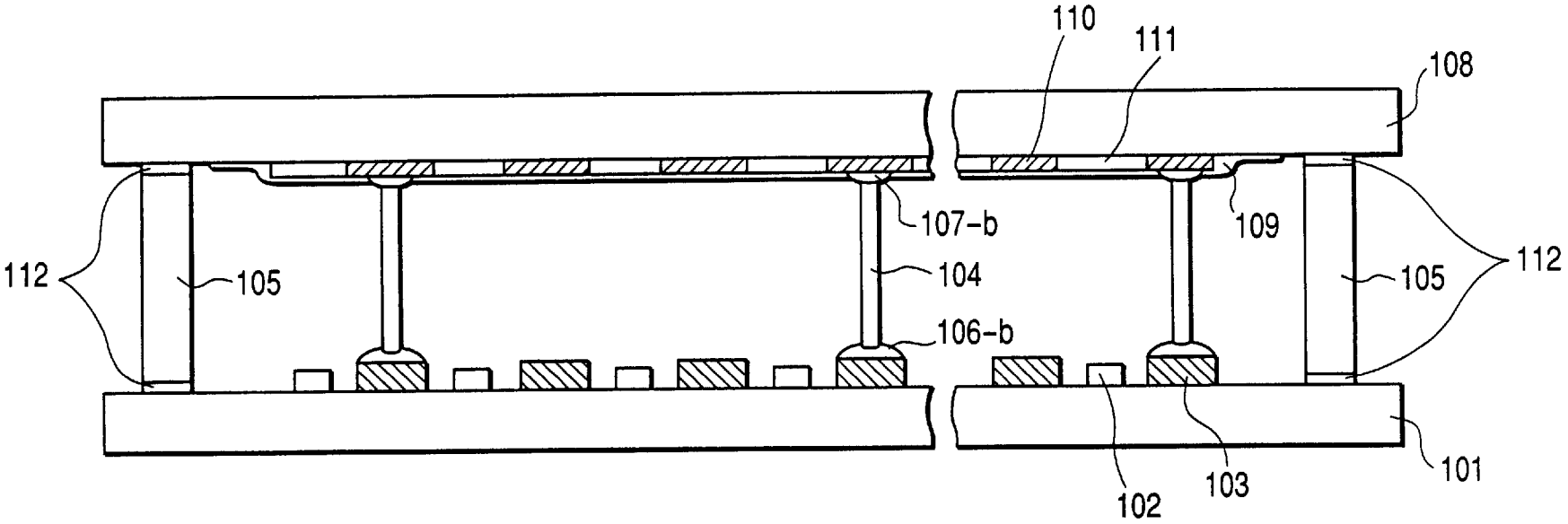
FIG. 1 is a cross-sectional view which illustrates the structural example of an image forming apparatus in accordance with the present invention.

At first, the image forming apparatus of the present invention includes an image indication device, such as a liquid crystal display panel, a plasma display panel, an electron beam display panel, for example. Each of these image forming apparatuses is structured so as to arrange in its container image forming means and spacers to keep a gap in the container.

For example, the electron beam display panel of the aforesaid image formation means comprises the electron discharging devices, and the image formation member that forms images by the irradiation of electron beams form the electron discharging devices. The image formation member is the emitter that emits light by means of the electrodes that accelerate the electron, and the irradiation of the electron, for example.

Also, the container of the electron beam display panel is formed of a member that comprises the first substrate provided with the electron discharging devices and the second substrate provided with the image formation member, which are arranged with a gap to each other.

Also, the spacers of the image forming apparatus of the present invention include both the insulating spacers and the conductive ones.

Also, the bonding material used for the present invention should preferably be an inorganic bonding gent. When the bonding agent is heated, it generates gas. However, the inorganic bonding agent is able to reduce the influence that may be exerted on the image formation means arranged on the substrate where the spacers should be bonded more than the organic bonding agent. Also, for the present invention, it is particularly preferable to use a chemically reactive bonding agent excellent in the heat resistance, which enables bonding with the frit glass or some other thermal fusion type bonding agent at a comparatively low temperature.

As the chemically reactive bonding agent, it may be possible to use alkaline metal silicate bonding agent, acid metal phosphate bonding agent, colloidal silica, and the like, for example.

In accordance with the present invention, any one of the chemically reactive type inorganic bonding agents may be adoptable, but it is preferable to use an alkaline metal silicate bonding agent, or an acid metal phosphate bonding agent, which is useable for the thermal bonding at a temperature of approximately 300° C., and which is also resistive to heat of as high as 1,000° C. or more. In this respect, it is particularly preferable to use the alkaline metal silicate bonding agent.

Both the alkaline metal silicate bonding agent and the acid metal phosphate bonding agent contain the bonding agent and frame material. The alkaline metal silicate bonding agent contains the alkaline metal silicate which is expressed by the general formula of $M_2 \cdot mSiO_2 \cdot nH_2O$ (where M is Na, K or Li, and m, and n, are integers 1 or more, respectively) as the bonding agent, and contains any one kind of alumina, silica, or zirconia as the frame material. Also, the acid metal phosphate bonding agent contains the acid metal salt which is expressed by the general formula of $MO \cdot Mp_2O_5 \cdot nH_2O$ (where M is Al or Mg, and m and n are integers 1 or more, respectively) as the bonding agent, and contains any one kind of alumina, silica, or zirconia as the frame material.

Also, in accordance with the present invention, if a conductive member is adopted as a member for use of the bonding, metallic particles are mixed in the chemically reactive inorganic bonding agent described above. In this case, silver or the like is used as the metallic particles. The mixture ratio thereof is 10 to 50 w % to the entire amount of the bonding material.

Now, hereunder, the specific description will be made of the method for manufacturing an image forming apparatus in accordance with the preferred embodiments of the present invention.

First Embodiment

As the preferred embodiment of the present invention, the description will be made of an image forming apparatus using the surface conductive type electron discharging devices as shown in FIG. 1.

FIG. 1 is a cross-sectional view showing schematically the image forming apparatus that uses the surface conductive type electron discharging devices. In FIG. 1, a reference numeral 101 designates a rear plate formed by soda glass or the like; 103 wiring electrodes; 102, the surface conductive type electron discharging devices. Each of the electron discharging devices 102 is electrically connected with the line wiring and the column wiring as well, thus being wired in matrix by both of them, respectively.

Also, a reference numeral 104 designates each of the conductive supporting members (spacers) to resist the atmospheric pressure, the insulated substrate surface of which is covered by the conductive film 105;

106-*b*, the connecting member between the spacer and the rear plate to bond the spacer 104 with the rear plate 101; and 107-*b*, the connecting member between the spacer and the face plate to bond the spacer 104 and the face plate 108.

Also, the face plate 108 comprises the acceleration electrode 109 which becomes the metal back, the black stripes 110, and the fluorescent devices 111.

Also, between the face plate 108 and the rear plate 101, the outer frame member 105 is arranged. Here, a reference numeral 112 designates the bonding member that bonds the face plate 108, the rear plate 101, and others with the outer frame 105.

Now, the connection of the supporting members (spacers) 104 to resist the atmospheric pressure will be described. The supporting members (spacers) 104 to resist the atmospheric pressure are connected with the face plate 108 and the rear plate 101 by means of the connecting members 107-*b* and 106-*b*. With the spacers 104 thus arranged, it becomes possible to mechanically support the gap between the face plate 108 and the rear plate 101 of the container formed by the face palate 108, the rear plate 101, and the outer frame member 105.

Figure 2A:
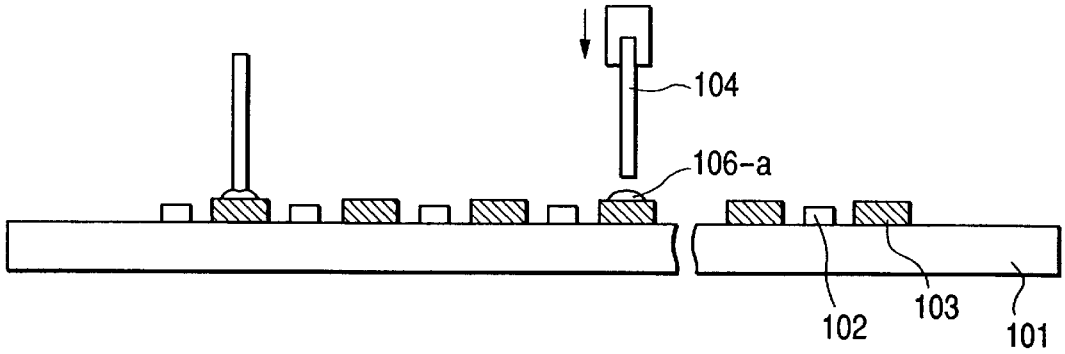
FIGS. 2A, 2B and 2C are views which illustrate one example of a method for manufacturing the image forming apparatus shown in FIG. 1.

Now, in conjunction with FIGS. 2A to 2C, the description will be made of the method for manufacturing the container of the image forming apparatus.

At first, each of the connecting members 106-*b* is formed between the spacers and the rear plate on the line wiring 103 on the rear plate 101. Then, the paste type bonding agent 106-*a* is applied by use of a dispenser, and before the paste is dried, the supporting member (spacer) 104 to resist the atmospheric pressure is positioned by use of the robot hand to press it against the coated portion, thus holding it until the paste is dried (FIG. 2A). Here, in accordance with the present embodiment, the alkaline metal silicate bonding agent (Alon-ceramics W: manufactured by Toa Gosei K.K.) is mixed with silver particles for use as the bonding agent 106-*a*.

Figure 2B:
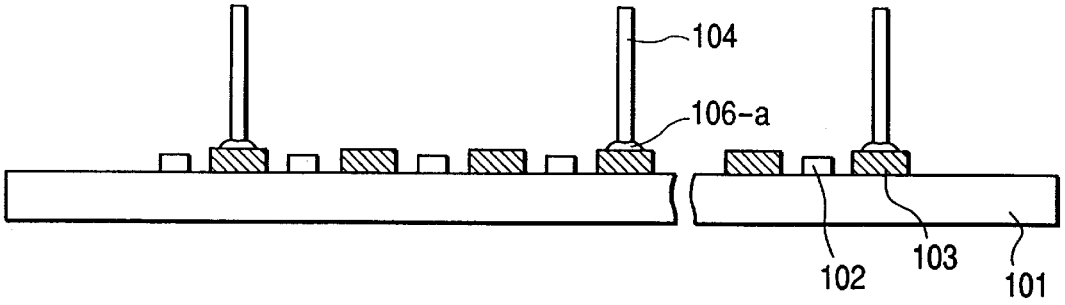
Figure 2C:
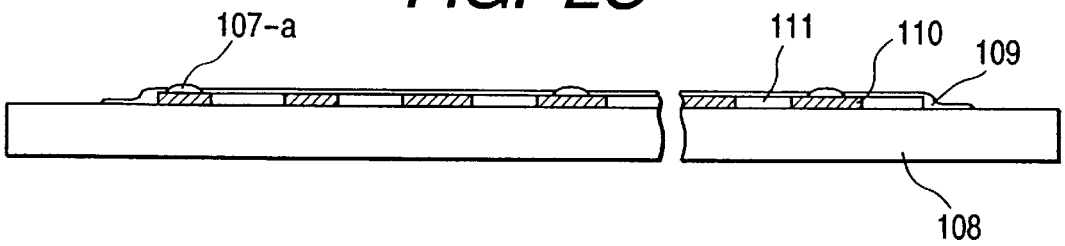

As shown in FIG. 2B, all of the spacers 104 are dried to be fixed. Then, the conductive frit glass is coated by use of the dispenser as the bonding agent 107-*a* on each position corresponding to the wiring of the rear plate on the face plate in order to form the connecting members 107-*b* between the spacers and the face plate (FIG. 2C). After that, burning is performed tentatively. Then, after the frit glass is coated on the contacted faces of the outer frame member 105 on the face plate side and the rear plate side, the tentative burning is performed. The outer frame member thus arranged, and the face plate 108 as well as the rear plate 101 are positioned, and heated at a temperature of 420° C. to assemble the container as described above.

Second Embodiment

Now, in conjunction with FIGS. 2A to 2C, the method for manufacturing an image forming apparatus will be described, in which the insulation spacers are used as the spacers 104 of the image forming apparatus shown in FIG. 1 described in accordance with the first embodiment as described above.

At first, on the line wiring 103 on the rear plate 101, the bonding agent 106-*a* is coated by use of the dispenser to form each of the connecting members 106-*b* between the spacers each having the insulation substrate, and the rear plate. Then, before the bonding agent is dried, each of the supporting members (spacers) 104 to resist the atmospheric pressure is positioned by means of the robot hand to be pressed to the coated portion, which is held until the bonding agent is dried (FIG. 2A). Here, as the bonding agent 106-*a*, the alkaline metal silicate bonding agent (Alon-ceramics W: manufactured by Toa Gosei K.K.) is used.

As shown in FIG. 2B, all of the spacers 104 are dried to be fixed. Then, the frit glass is coated by use of the dispenser as the bonding agent 107-*b* on each position corresponding to the wiring of the rear plate on the face plate 108 in order to form the connecting members 107-*a* between the spacers and the face plate (FIG. 2C). After that, burning is performed tentatively.

Then, after the frit glass is coated on the contacted faces of the outer frame member 105 on the face plate side and the rear plate side, the tentative burning is performed. The outer frame member thus arranged, and the face plate 108 as well as the rear plate 101 are positioned, and heated at a temperature of 420° C. to assemble the container comprising the face plate 108, the rear plate 101, and the outer frame 105 as shown in FIG. 1.

Third Embodiment

In conjunction with FIGS. 2A to 2C and FIG. 3, the description will be made of another method for manufacturing the image forming apparatus represented in FIG. 1 described in accordance with the second embodiment as above.

Figure 3:
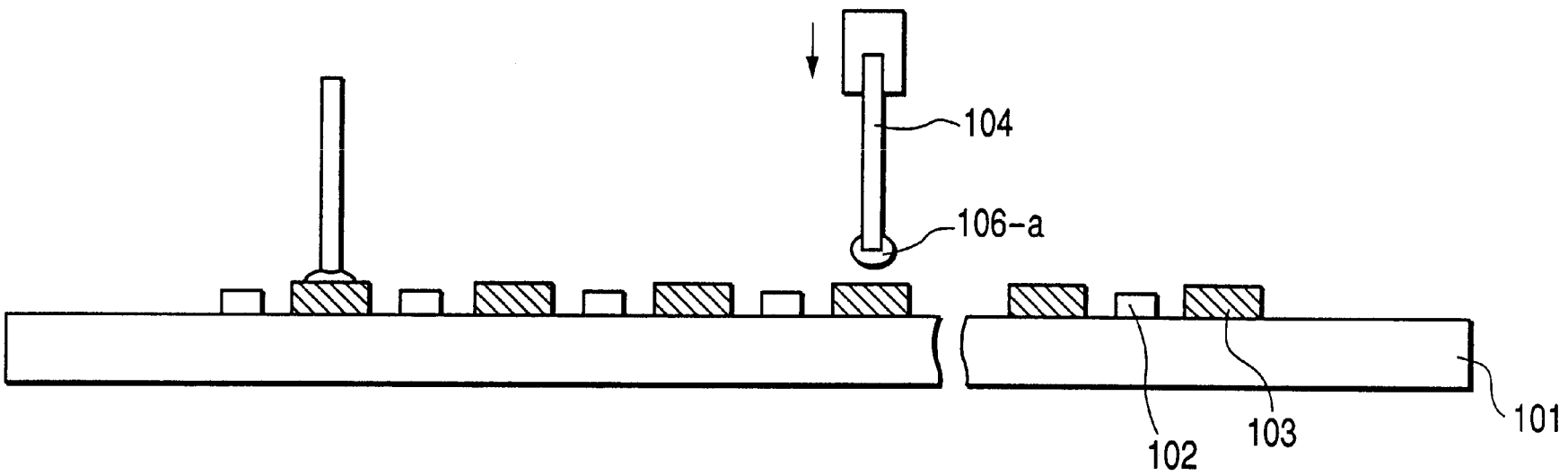
FIG. 3 is a view which illustrates another example of the method for manufacturing the image forming apparatus shown in FIG. 1.

At first, the alkaline metal silicate bonding agent (Alon-ceramics W: manufactured by Toa Gosei K.K.) 106-*a* is applied to one end of each of the spacers 104 having the insulation substrate. Then, on the line wiring 103 on the rear plate 101, the spacer 104 is positioned by means of the robot hand to be pressed on it, which is held until the bonding agent is dried (FIG. 3).

Thereafter, as in the second embodiment, all of the spacers 104 are dried to be fixed (FIG. 2B). In the position corresponding to the line wiring of the rear plate on the face plate 108, the frit glass is coated by means of the dispenser as the bonding agent 107-*a* to form the connecting members 107-*b* between the spacers and the face plate. Then, the tentative burning is performed (FIG. 2C).

After the frit glass is coated both on the contacted faces of the outer member 105 on the face plate side and the rear plate side, the tentative burning is performed. Then, the outer frame member thus arranged, and the face plate 108 as well as the rear plate 101 are positioned, and heated at a temperature of 420° C. to assemble the container comprising the face plate 108, the rear plate 101, and the outer frame 105 as shown in FIG. 1.

Here, in accordance with the present embodiment, the insulation spacers are used as the supporting members (spacers) to resist the atmospheric pressure. However, as in the first embodiment, the conductive spacers and the bonding agents 106-*a* and 107-*a* are used to produce the image forming apparatus having the conductive spacers arranged as the spacer 104 as shown in FIG. 1 by the same method as in the present embodiment.

In accordance with the first to third embodiments described above, it becomes possible to reduce the heating step in the manufacturing process by bonding one end of each spacer with the substrate by pressing it to the substrate to dry it without heating at high temperatures.

Also, in accordance with the first to third embodiments described above, one end of each spacer is bonded to the substrate where the electron discharging devices are arranged without heating them at high temperatures. To the substrate, each of the spacers is pressed through the bonding agent and dried. As a result, it becomes possible to suppress the degradation of the properties of the electron discharging devices, which may be caused otherwise by the heating process at high temperatures repeated in several times.

Also, in accordance with the first to third embodiments described above, one end of each spacer and the substrate are bonded without heating at high temperatures, but by pressing the spacer to the substrate through the bonding agent to dry it. The chemically reactive bonding agent thus used is able to fix each of the spacers only by drying. Then, when the container is assembled, heating is performed to provide the sufficient holding function for the spacers as those which resist the atmospheric pressure.

Also, in accordance with the first to third embodiments described above, one end of each spacer is bonded with the substrate having the electron discharging devices by the application of inorganic bonding agent, and even by heating at the time of the container assembling to follow, it becomes possible to suppress the degradation of the properties of the electron discharging devices which may be caused by the gas given off when the organic bonding agent is used.

Fourth Embodiment

Figure 4A:
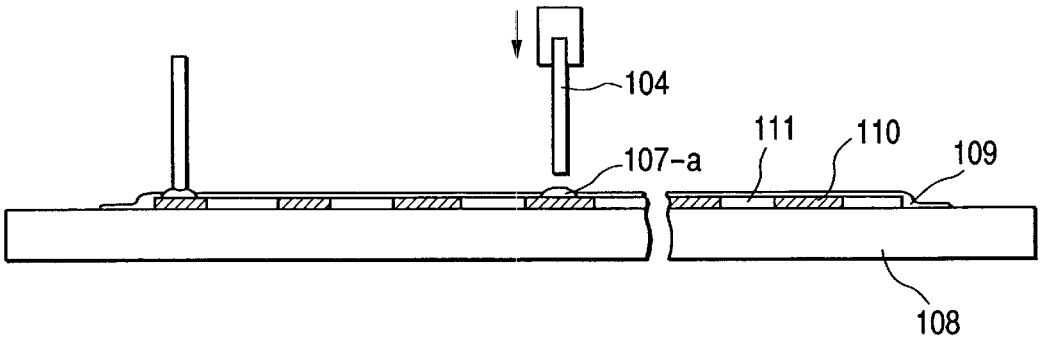
FIGS. 4A, 4B and 4C are views which illustrate still another example of the method for manufacturing the image forming apparatus shown in FIG. 1

Now, in conjunction with FIGS. 4A to 4C, the description will be made of still another method for manufacturing the image forming apparatus shown in FIG. 1 described in accordance with the second embodiment as above.

At first, on the black stripes 110 on the face plate 108, the bonding agent 107-*a* is coated by use of the dispenser to form each of the connecting members 107-*b* between the spacers each having the insulation substrate, and the face plate. Then, before the bonding agent is dried, each of the supporting members (spacers) 104 to resist the atmospheric pressure is positioned by means of the robot hand to be pressed to the coated portion, which is held until the bonding agent is dried (FIG. 4A). Here, as the bonding agent, the alkaline metal silicate bonding agent (Alon-ceramics W: manufactured by Toa Gosei K.K.) is used.

Figure 4B:
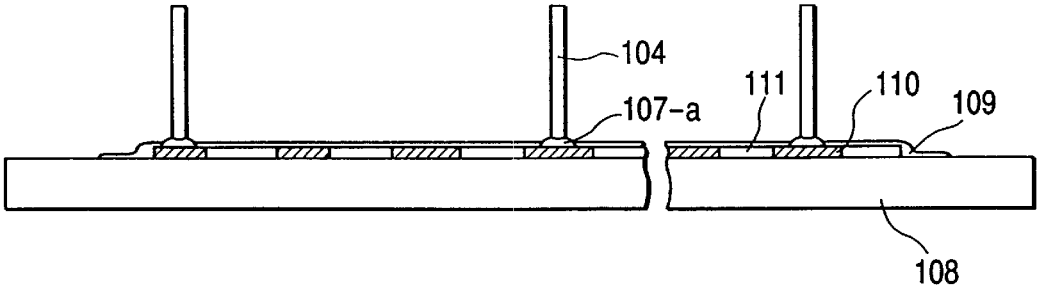
Figure 4C:
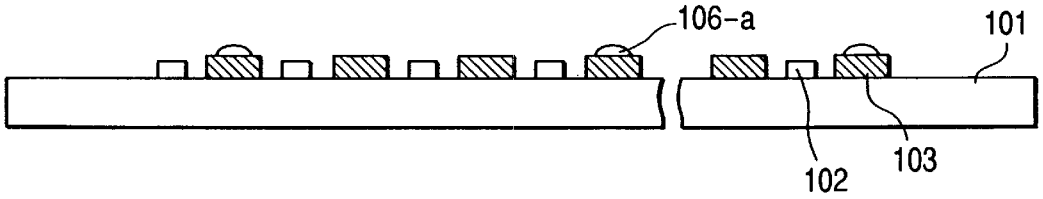

As shown in FIG. 4B, all of the spacers 104 are dried to be fixed. Then, in the position corresponding to the black stripes 110 of the face plate 108 on the wiring 103 on the rear plate 101, the frit glass is coated by use of the dispenser as the bonding agent 106-*a* to form the connecting members 106-*b* between the spacers and the rear plate. After that, burning is performed tentatively (FIG. 4C).

Then, after the frit glass is coated both on the contacted faces of the outer frame member 105 on the face plate side and the rear plate side, the tentative burning is performed. The outer frame member thus arranged, and the face plate 108 as well as the rear plate 101 are positioned, and heated at a temperature of 420° C. to assemble the container comprising the face plate 108, the rear plate 101, and the outer frame 105 as shown in FIG. 1.

Here, in accordance with the present embodiment, the insulation spacers are used as the supporting members (spacers) to resist the atmospheric pressure, but as the conductive spacers, and bonding agents 107-*a* and 106-*a* as in the first embodiment, the bonding agents 106-*a* and 107-*a* are used, respectively, as in the first embodiment to produce the image forming apparatus shown in FIG. 1 by the same method as the present embodiment, which is provided with the conductive spacers.

Fifth Embodiment

Now, in conjunction with FIGS. 4A to 4C and FIG. 5, the description will be made of still another method for manufacturing the image forming apparatus shown in FIG. 1 described in accordance with the second embodiment as above.

Figure 5:
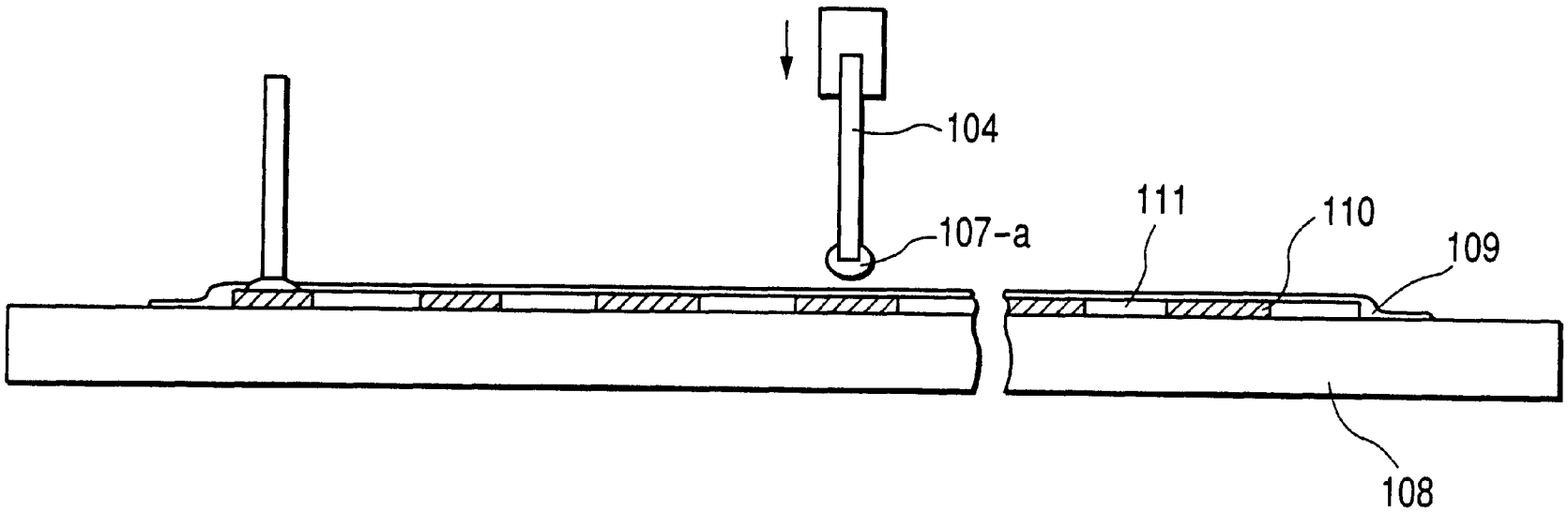
FIG. 5 is a view which illustrates still another example of the method for manufacturing the image forming apparatus shown in FIG. 1

At first, for one end of each of the spacers 104, the alkaline metal silicate bonding agent (Alon-ceramics W: 107-*a* is provided, and the spacer 104 is positioned by used of the robot hand on the black stripe 110 on the face plate 108. It is pressed and held until the bonding agent is dried (FIG. 5).

Thereafter, as in the fourth embodiment, all of the spacers 104 are dried to be fixed (FIG. 4B). Then, the frit glass is coated by use of the dispenser as the bonding agent 106-*a* on each position corresponding to the black stripes 110 of the rear plate 101 on the face plate 108 in order to form the connecting members 106-*b* between the spacers and the rear plate. After that, burning is performed tentatively (FIG. 4C).

Then, after the frit glass is coated both on the contacted faces of the outer frame member 105 on the face plate side and the rear plate side, the tentative burning is performed. The outer frame member thus arranged, and the face plate 108 as well as the rear plate 101 are positioned, and heated at a temperature of 420° C. to assemble the container comprising the face plate 108, the rear plate 101, and the outer frame 105 as shown in FIG. 1.

Here, in accordance with the present embodiment, the insulation spacers are used as the supporting members (spacers) to resist the atmospheric pressure, but as the same conductive spacers, and bonding agents 107-*a* and 106-*a* as the first embodiment, the bonding agents 106-*a* and 107-*a* are used, respectively, as in the first embodiment to produce the image forming apparatus shown in FIG. 1 by the same method as the present embodiment, which is provided with the conductive spacers as the spacers 104.

Also, in the fourth and fifth embodiments as described above, one end of each spacer is bonded with the substrate by pressing the spacer to the substrate through the bonding agent to be dried without heating them at high temperatures, to make it possible to reduce the heating step in the manufacturing process.

Also, in accordance with the fourth and fifth embodiments described above, each end of the spacers and the substrate are bonded without heating at high temperatures, but pressing them through the bonding agent to be dried for the fixation. The chemically reactive type bonding agent enables the spacers to be fixed only by drying. Subsequently, however, heating is given at the time of container assembling to provide the sufficient holding function for them as the spacers to resist the atmospheric pressure.

Sixth Embodiment

Now, for the present embodiment, the description will be made of a method for manufacturing an image forming apparatus in conjunction with FIG. 6.

Figure 6:
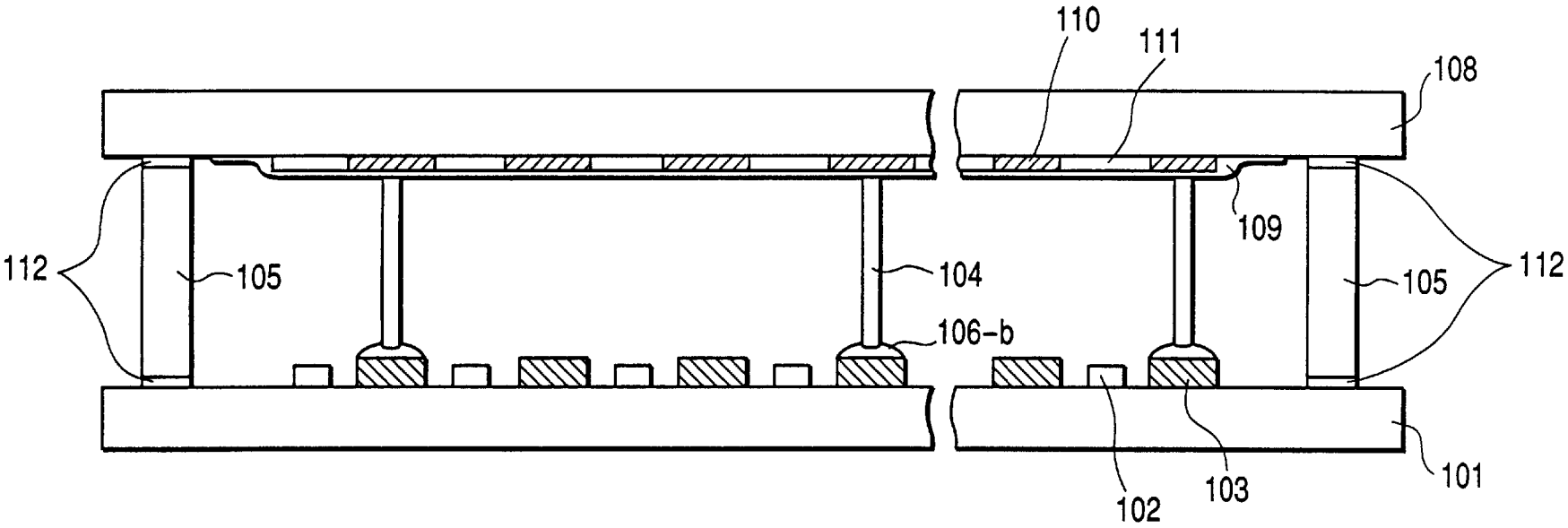
FIG. 6 is a cross-sectional view which illustrates another structural example of an image forming apparatus in accordance with the present invention.

The image forming apparatus shown in FIG. 6 is different from the one shown in FIG. 1 described in accordance with each of the embodiments as above in that there is no connecting member between the face plate 108 and the spacers 104.

Hereunder, therefore, the description will be made of a method for producing the container formed by the rear plate 101, the face plate 108, and the outer frame 105 for the image forming apparatus shown in FIG. 6.

At first, on the line wiring 103 on the rear plate 101, the bonding agent 106-*a* is coated by use of the dispenser to form each of the connecting members 106-*b* between the spacers each having the insulation substrate, and the rear plate. Then, before the bonding agent is dried, each of the supporting members (spacers) 104 to resist the atmospheric pressure is positioned by means of the robot hand to be pressed to the coated portion, which is held until the bonding agent is dried (FIG. 2A). Here, as the bonding agent, the alkaline metal silicate bonding agent (Alon-ceramics W: manufactured by Toa Gosei K.K.) is used.

Subsequently, as shown in FIG. 2B, all of the spacers 104 are dried to be fixed.

Then, after the frit glass is coated on the contacted faces of the outer frame member 105 on the face plate side and the rear plate side, the tentative burning is performed. The outer frame member thus arranged, and the face plate 108 as well as the rear plate 101 are positioned, and heated at a temperature of 420° C. to assemble the container comprising the face plate 108, the rear plate 101, and the outer frame 105 as shown in FIG. 6.

Here, in accordance with the present embodiment, the insulation spacers are used as the supporting members (spacers) to resist the atmospheric pressure, but the same conductive spacers and the bonding agent 106-*a* as the first embodiment are used to produce the image forming apparatus shown in FIG. 6 by the same method as the present embodiment, which is provided with the conductive spacers as the spacers 104.

Also, in the sixth embodiment as described above, one end of each spacer is bonded with the substrate by pressing the spacer to the substrate through the bonding agent to be dried without heating them at high temperatures. Further, in accordance with the sixth embodiment, the other end of each spacer is bonded by use of a bonding agent but not given any thermal bonding. As a result, it becomes possible to reduce the heating step still more in the manufacture process.

Also, in accordance with the sixth embodiment described above, each end of the spacers and the substrate where the electron discharging devices are arranged are bonded without heating at high temperatures, but pressing them through the bonding agent to be dried for the fixation. Further, in accordance with the sixth embodiment, the other end of each spacer is bonded by use of the bonding agent, but not given any thermal bonding. As a result, it becomes possible to suppress still more the degradation of properties of the electron discharging devices due to the heating process at high temperatures which is repeated a plurality times.

Also, in accordance with the sixth embodiment described above, each end of the spacers and the substrate are bonded without heating at high temperatures, but pressing them through the bonding agent to be dried for the fixation. The chemically reactive type bonding agent enables the spacers to be fixed only by drying. Subsequently, however, heating is given at the time of container assembling to provide the sufficient holding function for them as the spacers to resist the atmospheric pressure.

Also, in accordance with the sixth embodiment described above, one end of each spacer is bonded with the substrate having the electron discharging devices by the application of an inorganic bonding agent, and even by heating at the time of the container assembling to follow, it becomes possible to suppress the degradation of the properties of the electron discharging devices which may be caused by the gas given off when the organic bonding agent is used.

Seventh Embodiment

For the present embodiment, the description will be made of a method for manufacturing an image forming apparatus in conjunction with FIG. 7.

Figure 7:
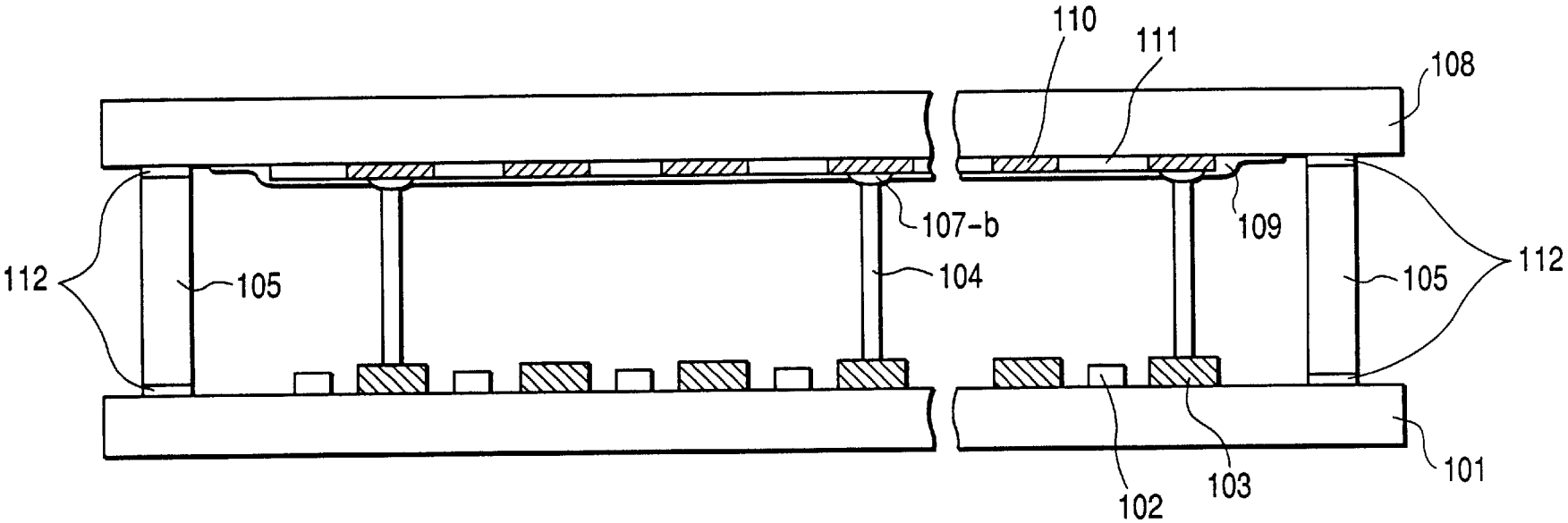
FIG. 7 is a cross-sectional view which illustrates still another structural example of an image forming apparatus in accordance with the present invention.

The image forming apparatus shown in FIG. 7 is different from the one shown in FIG. 1 described in accordance with each of the first to fifth embodiments as above in that there is no connecting member between the rear plate 101 and the spacers 104.

At first, on the black stripes 110 on the face plate 108, the bonding agent 107-*a* is coated by use of the dispenser to form each of the connecting members 107-*b* between the spacers each having the insulation substrate, and the face plate. Then, before the bonding agent is dried, each of the supporting members (spacers) 104 to resist the atmospheric pressure is positioned by means of the robot hand to be pressed to the coated portion, which is held until the bonding agent is dried (FIG. 4A). Here, as the bonding agent, the alkaline metal silicate bonding agent (Alon-ceramics W: manufactured by Toa Gosei K.K.) is used.

Subsequently, as shown in FIG. 4B, all of the spacers 104 are dried to be fixed.

Then, after the frit glass is coated both on the contacted faces of the outer frame member 105 on the face plate side and the rear plate side, the tentative burning is performed. The outer frame member thus arranged, and the face plate 108 as well as the rear plate 101 are positioned, and heated at a temperature of 420° C. to assemble the container comprising the face plate 108, the rear plate 101, and the outer frame 105 as shown in FIG. 1.

Here, in accordance with the present embodiment, the insulation spacers are used as the supporting members (spacers) to resist the atmospheric pressure, but the same conductive spacers as the first embodiment, and the same bonding agent 106-*a* as the first embodiment as the bonding agent 107-*a* are used, and then, the image forming apparatus shown in FIG. 7 is produced by the same method as the present embodiment, in which the conductive spacers are arranged as the spacers 104.

As described above, in accordance with the seventh embodiment, too, one end of each spacer is bonded with the substrate by pressing the spacer to the substrate through the bonding agent to be dried without heating them at high temperatures. Further, the other end of each spacer is bonded by use of a bonding agent but not given any thermal bonding. As a result, it becomes possible to reduce the heating step still more in the manufacturing process.

Also, in accordance with the seventh embodiment described above, each end of the spacers and the substrate are bonded without heating at high temperatures, but pressing them through the bonding agent to be dried for the fixation. The chemically reactive type bonding agent enables the spacers to be fixed only by drying. Subsequently, however, heating is given at the time of container assembling to provide the sufficient holding function for them as the spacers to resist the atmospheric pressure.

Also, in accordance with the seventh embodiment described above, the spacers are in contact with the substrate where the electron discharging devices are arranged without using bonding agent, it is possible to suppress the degradation of the properties of the electron discharging devices which may be caused by the gas which should be given off from the bonding agent if any is used.

Eighth Embodiment

In conjunction with FIGS. 8A to 8D, the description will be made of still another method for manufacturing the image forming apparatus shown in FIG. 1 described in accordance with the second embodiment as above.

Figure 8A:
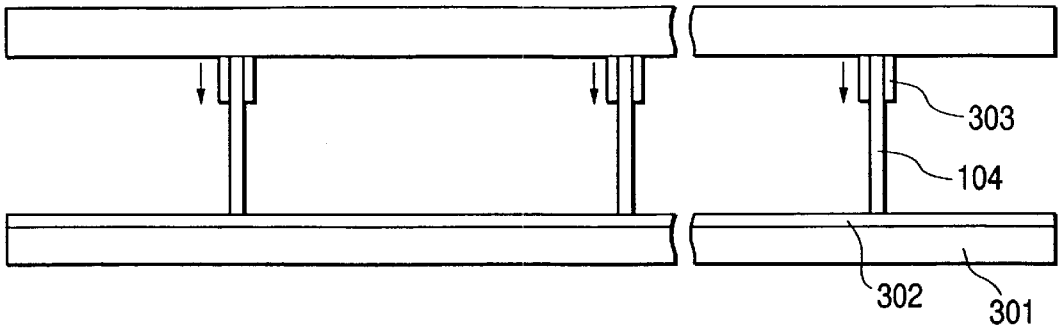
FIGS. 8A, 8B, 8C and 8D are views which illustrate still a further example of the method for manufacturing the image forming apparatus shown in FIG. 1.

At first, one end of each of the supporting members (spacers) 104 to resist the atmospheric pressure, which is formed with the insulation substrate held in each of the jigs 303, is pressed to the thin film 302 of the alkaline metal silicate bonding (Alon-ceramics W: manufactured by Toa Gosei K.K.) formed on the substrate 301 by means of coating (FIG. 8A).

Figure 8B:
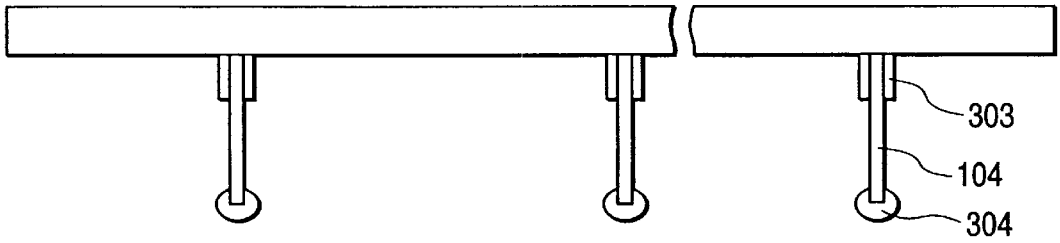

Then, on one end of each spacer 104, a pool of the aforesaid bonding agent 304 is formed (FIG. 8B).

Figure 8C:
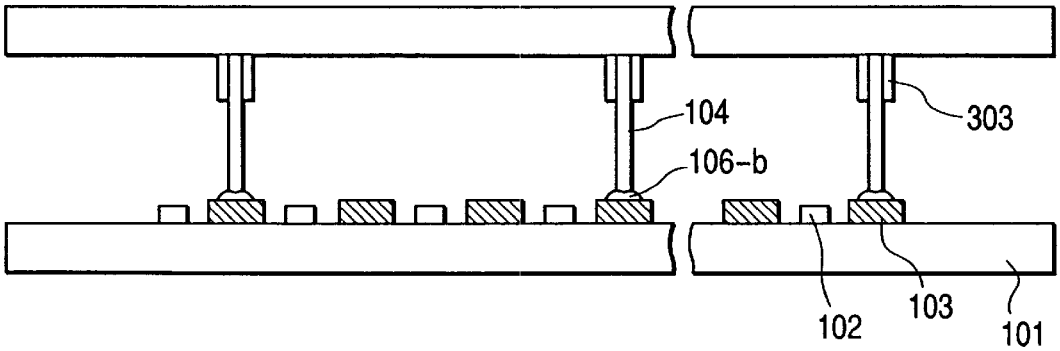
Figure 8D:
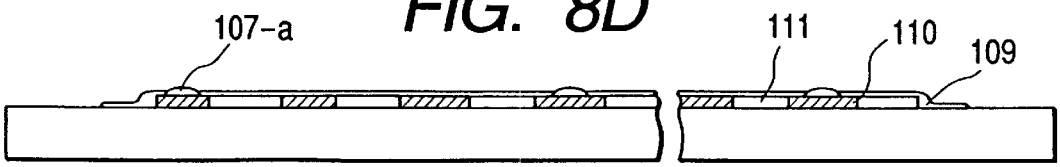

On the line wiring 103 on the rear plate 101, each of the spacers 104 is positioned and arranged, and heated at a temperature of 200° C. to form each of the connection members 106-*b* between the spacers and the rear plate (FIG. 8C).

In the position corresponding to the wiring on the rear plate on the face plate 108, the frit glass is coated by means of the dispenser as the bonding agent 107-*a* that forms the connecting members 107-*b* between the spacers and the face plate (FIG. 8C). After that, the tentative burning is performed.

Then, after the frit glass is coated both on the contacted faces of the outer frame member 105 on the face plate side and the rear plate side, the tentative burning is performed. The outer frame member thus arranged, and the face plate 108 as well as the rear plate 101 are positioned, and heated at a temperature of 420° C. to assemble the container comprising the face plate 108, the rear plate 101, and the outer frame 105 as shown in FIG. 1.

Here, in accordance with the present embodiment, the insulation spacers are used as the supporting members (spacers) to resist the atmospheric pressure, but the same conductive spacers as the first embodiment, and the same bonding agent 106-*a* as the first embodiment as the bonding agent 107-*a* are used, and then, the image forming apparatus shown in FIG. 1 is produced by the same method as the present embodiment, in which the conductive spacers are arranged as the spacers 104.

As described above, in accordance with the eighth embodiment, it is possible to bond one end of each with the substrate by use of the chemically reactive type bonding agent with a lower temperature heating of 200° C. approximately, hence suppressing the degradation of the properties of the electron discharging devices in the high temperature heating which is repeated in plural times.

Also, in accordance with the eighth embodiment, too, one end of each of the spacers and the substrate where the electron discharging devices are arranged are bonded by use of the inorganic bonding agent. Therefore, it is possible to suppress the degradation of the properties of the electron discharging devices due to the gas which should be given off from the organic bonding agent if any used.

Ninth Embodiment

For the present embodiment, the description will be made of still another method for manufacturing an image forming apparatus described in conjunction with FIG. 6.

The image forming apparatus shown in FIG. 6 is different from the image forming apparatus shown in FIG. 1 described in accordance with the first to fifth, and eighth embodiments in that there is no connecting members between the face plate 108 and the spacers 104.

Hereunder, therefore, the description will be made of a method for producing a container formed by the rear plate 101, the face plate 108, and the outer member 105 of the image forming apparatus shown in FIG. 6.

At first, one end of each of the supporting members (spacers) 104 to resist the atmospheric pressure, which is formed with the insulation substrate held in each of the jigs 303, is pressed to the thin film 302 of the alkaline metal silicate bonding (Alon-ceramics W: manufactured by Toa Gosei K.K.) formed on the substrate 301 by means of coating (FIG. 8A).

Then, on one end of each spacer 104, a pool of the aforesaid bonding agent 304 is formed (FIG. 8B).

On the line wiring 103 on the rear plate 101, each of the spacers 104 is positioned and arranged, and heated at a temperature of 200° C. to form each of the connection members 106-*b* between the spacers and the rear plate (FIG. 8C).

Then, the frit glass is coated both on the contacted surface of the outer member 105 on the face plate side and the rear plate side, and the tentative burning is performed. The outer frame member thus arranged, and the face plate 108 as well as the rear plate 101 are positioned, and heated at a temperature of 420° C. to assemble the container comprising the face plate 108, the rear plate 101, and the outer frame 105 as shown in FIG. 6.

Here, in accordance with the present embodiment, the insulation spacers are used as the supporting members (spacers) to resist the atmospheric pressure, but the same conductive spacers and the same bonding agent 106-*a* are used, and then, the image forming apparatus shown in FIG. 7 is produced by the same method as the present embodiment, in which the conductive spacers are arranged as the spacers 104.

Also, in accordance with the ninth embodiment, too, one end of each of the spacers and the substrate are bonded by use of the chemically reactive bonding, thus making the low temperature heating possible at a temperature of approximately 200° C. to suppress the degradation of the properties of the electron discharging devices in the heating process at high temperatures in plural times.

As described above, in accordance with the ninth embodiment, it is possible to bond one end of each with the substrate by use of the chemically reactive type bonding agent with a lower temperature heating of 200° C. approximately. Further, no thermal bonding is performed on the other end of each spacer using a bonding agent, either. As a result, it is possible to reduce still more the heating step in the manufacturing process.

Also, in accordance with the ninth embodiment, it is possible to bond one end of each with the substrate by use of the chemically reactive type bonding agent with a lower temperature heating of 200° C. approximately. Further, no thermal bonding is performed on the other end of each spacer using any bonding agent, either. As a result, it is possible to suppress still more the degradation of the properties of the electron discharging devices in the high temperature heating which is repeated a plurality of times.

Also, in accordance with the ninth embodiment, too, one end of each of the spacers and the substrate where the electron discharging devices are arranged are bonded by use of the inorganic bonding agent. As a result, even if the bonding agent is heated, it is possible to suppress the degradation of the properties of the electron discharging devices due to the gas which should be given off from the organic bonding agent.

Tenth Embodiment

For the present embodiment, the description will be made of still another method for manufacturing an image forming apparatus described in conjunction with FIG. 7.

The image forming apparatus shown in FIG. 7 is different from the image forming apparatus shown in FIG. 1 described in accordance with the first to fifth, and eighth embodiments in that there is no connecting members between the rear plate 101 and the spacers 104.

At first, one end of each of the supporting members (spacers) 104 to resist the atmospheric pressure, which is formed with the insulation substrate held in each of the jigs 303, is pressed to the thin film 302 of the alkaline metal silicate bonding (Alon-ceramics W: manufactured by Toa Gosei K.K.) formed on the substrate 301 by means of coating (FIG. 8A). Then, on one end of each spacer 104, a pool of the aforesaid bonding agent 304 is formed (FIG. 8B).

Figure 9:
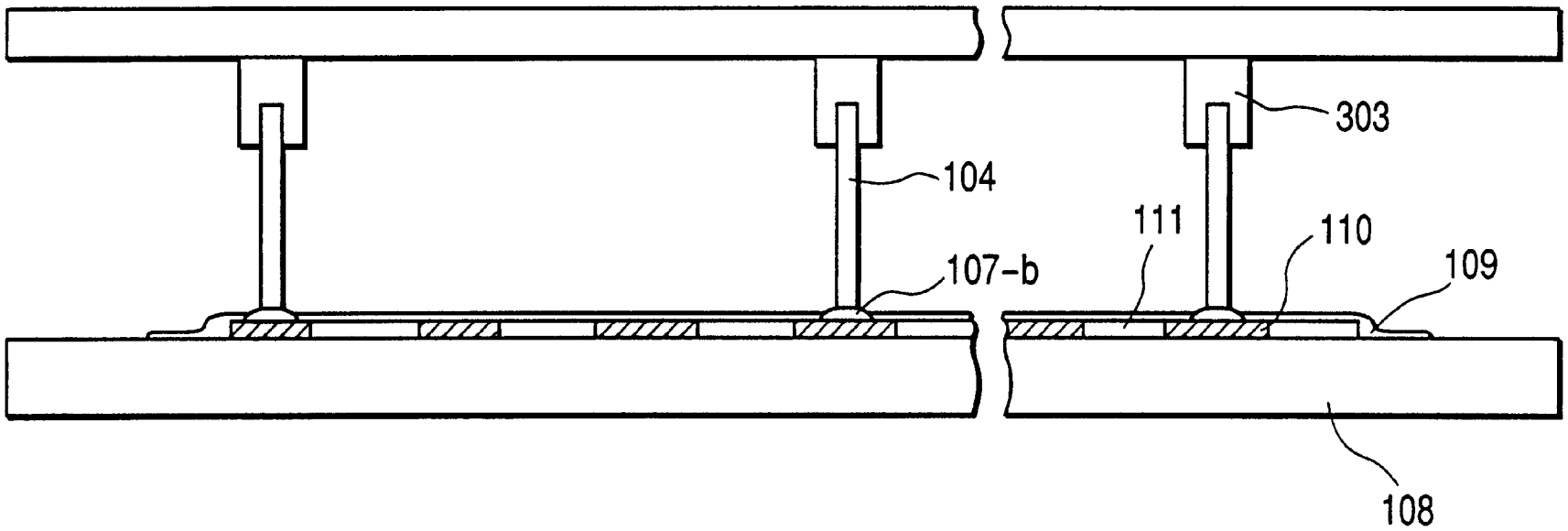
FIG. 9 is a view which illustrates the example of the method for manufacturing the image forming apparatus shown in FIG. 7.
Figure 10:
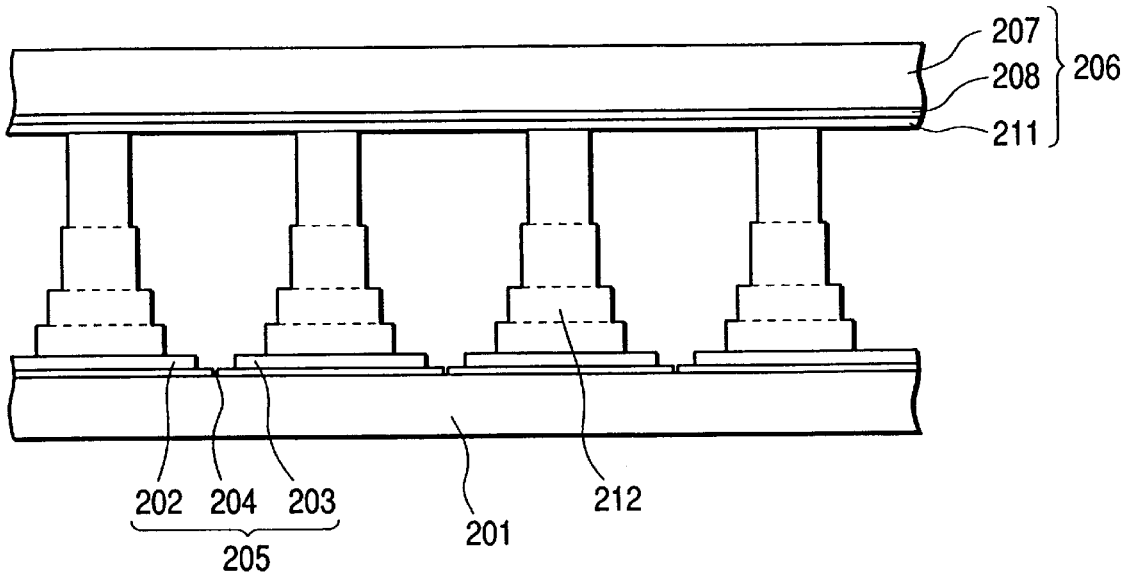
FIG. 10 is a cross-sectional view which shows one example of the conventional image forming apparatus.
Figure 11:
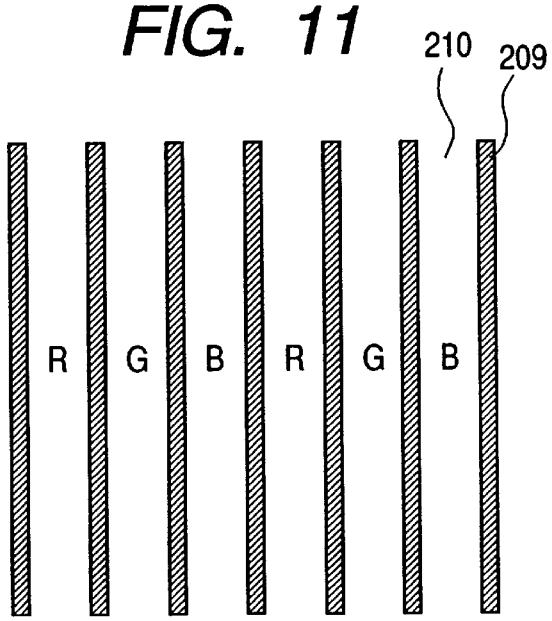
FIG. 11 is a view which shows one example of the fluorescent device of the conventional image forming apparatus.

On the black stripes 110 on the face plate 108, each of the spacers 104 is positioned and heated at a temperature of 200° C. to form the connecting members 107-*b* between the spacers and the face plate (FIG. 9).

Then, the frit glass is coated both on the contacted surface of the outer member 105 on the face plate side and the rear plate side, and the tentative burning is performed. The outer frame member thus arranged, and the face plate 108 as well as the rear plate 101 are positioned, and heated at a temperature of 420° C. to assemble the container comprising the face plate 108, the rear plate 101, and the outer frame 105 as shown in FIG. 7.

Here, in accordance with the present embodiment, the insulation spacers are used as the supporting members (spacers) to resist the atmospheric pressure, but the same conductive spacers and the same bonding agent 106-*a* are used, and then, the image forming apparatus shown in FIG. 7 is produced by the same method as the present embodiment, in which the conductive spacers are arranged as the spacers 104.

As described above, in accordance with the tenth embodiment, it is possible to bond one end of each with the substrate by use of the chemically reactive type bonding agent with a lower temperature heating of 200° C. approximately. Further, no thermal bonding is performed on the other end of each spacer using any bonding agent, either. As a result, it is possible to reduce still more the heating step in the manufacturing process.

Also, in accordance with the ninth embodiment, it is possible to bond one end of each with the substrate by use of the chemically reactive type bonding agent with a lower temperature heating of 200° C. approximately. Further, no thermal bonding is performed on the other end of each spacer using bonding agent, either. As a result, it is possible to suppress still more the degradation of the properties of the electron discharging devices in the high temperature heating which is repeated a plurality of times.

Also, in accordance with the tenth embodiment, too, the spacers are in contact with the substrate where the electron discharging devices are arranged without using any bonding agent, it becomes possible to suppress still more the degradation of the properties of the electron discharging devices.

Also, in accordance with the tenth embodiment described above, the spacers are in contact with the substrate where the electron discharging devices are arranged without using any bonding agent, making it possible to suppress the degradation of the properties of the electron discharging devices that may be caused by the gas which should be given off from the bonding agent if any used.

In accordance with the present invention, it becomes possible to reduce the heating step in the manufacturing process of an image forming apparatus.

Also, the present invention makes it possible to reduce the heating step at high temperatures in the manufacturing process of an image forming apparatus.

Also, in accordance with the present invention, it becomes possible to reduce the damages that may be caused on image forming means in the heating step in the manufacturing process of an image forming apparatus.

Also, with the present invention, it is possible to provide a simple method for manufacturing an image forming apparatus.

Also, with the present invention, it is possible to provide a method for manufacturing an image forming apparatus capable of forming high quality images.

What is claimed is:

1. A method for manufacturing an image forming apparatus provided with a container structured by a member including a first substrate and a second substrate with a gap between each other, image forming means comprising electron discharging devices and an image forming member arranged in the interior of the container, and spacers for maintaining the gap therebetween, said method comprising the following steps of:

bonding the spacers to the first substrate by use of a chemically reactive type bonding agent;

bonding the first substrate to the second substrate through an outer frame member, wherein the image forming member is arranged on the first substrate, and the electron discharging devices are arranged on the second substrate;

using at least one of alkaline metal silicate, acid metal phosphate and colloidal silica as the bonding agent; and providing no bonding agent between the spacers and the second substrate.

2. An image forming apparatus comprising:

a container structured by a member including a first substrate and a second substrate with a gap between each other;

image forming means comprising electron discharging devices and an image forming member arranged in an interior of said container;

a plurality of spacers to hold the gap between said first and second substrates, wherein said spacers are bonded to said first substrate by use of a chemically reactive type bonding agent; and an outer frame member bonding said first substrate to said second substrate, wherein said image forming means is arranged on said first substrate, and said electron discharging devices are arranged on said second substrate, and wherein said bonding agent is at least one of alkaline metal silicate, acid metal phosphate and colloidal silica, and no bonding agent is provided between said spacers and said second substrate.

* * * * *

UNITED STATES PATENT AND TRADEMARK OFFICE

CERTIFICATE OF CORRECTION

PATENT NO. : 6,152,796
DATED : November 28, 2000
INVENTOR(S) : Kohei Nakata

It is certified that error appears in the above-identified patent and that said Letters Patent is hereby corrected as shown below:

Column 4,
Line 8, "gent." should read -- agent. --
Line 36, "integers" should read -- integers of --.

Column 11,
Line 53, "in plural" should read -- a plurality of --.

Column 12,
Line 45, "in plural" should read -- a plurality of --.

Signed and Sealed this

Twelfth Day of February, 2002

*Attest:*

*Attesting Officer*

JAMES E. ROGAN
*Director of the United States Patent and Trademark Office*